United States Patent [19]

Naud

[11] Patent Number: 4,666,511

[45] Date of Patent: May 19, 1987

[54] PROCESS FOR PRODUCING KILLED STEEL HAVING A LOW NITROGEN CONTENT

[75] Inventor: Jean-Michael Naud, Versailles, France

[73] Assignee: L'Air Liquide, Paris, France

[21] Appl. No.: 843,781

[22] Filed: Mar. 25, 1986

[30] Foreign Application Priority Data

Apr. 1, 1985 [FR] France ..... 85 04909

[51] Int. Cl.[4] ..... C21C 7/00

[52] U.S. Cl. ..... 75/51.7; 75/53; 75/59.11; 75/59.29; 75/96; 266/236

[58] Field of Search ..... 75/59.11, 96, 59.29, 75/53, 51.7; 266/236

[56] References Cited

U.S. PATENT DOCUMENTS 3,052,936 9/1962 Hamilton ..... 75/53
3,224,051 12/1965 Brown ..... 75/53
3,230,074 1/1966 Roy ..... 75/49
3,258,328 6/1966 Goss ..... 75/57
4,089,678 5/1978 Hanawalt ..... 75/96

*Primary Examiner*—Peter D. Rosenberg
*Attorney, Agent, or Firm*—Lee C. Robinson, Jr.

[57] ABSTRACT

The process for producing killed steel having a low content of nitrogen comprises pouring an effervescent steel from a converter into a ladle in which there are added to the molten steel contained in the ladle, in the course of the pouring operation, additives for killing the steel, such as aluminium, silicon, etc. . . . The invention comprises pouring the effervescent steel into the ladle before introducing the killing additives, and prior to the introduction of the killing additives carbon dioxide in the form of carbon dioxide snow in the vicinity of the lower part of the pouring jet and on the surface of the bath of steel in the ladle in a quantity sufficient to protect the surface of the molten metal from the surrounding air upon the introduction of the killing additives into the ladle.

6 Claims, 3 Drawing Figures

PROCESS FOR PRODUCING KILLED STEEL HAVING A LOW NITROGEN CONTENT

The present invention relates to a process for producing killed steel having a low nitrogen content by the pouring of effervescent steel from a converter into a ladle, in which there are added to the molten steel contained in the ladle, in the course of the pouring operation, additives for killing this steel such as aluminium and/or silicon.

In the course of the preparation of metals, different constituents of the ore are eliminated while new bodies are inserted in the molten metal, especially in contact with the air.

Some metals or metal alloys may, in the course of their preparation, have their nitrogen content increased if special precautions are not taken. This is the case of, for example, steel when it is poured from a converter into a ladle or more generally from a supply container into a receiving container. It has been found that the presence of nitrogen in steel, in the form of interstitial impurities, encourages age hardening and reduces its strength. In particular, it is found that a metal sheet having an excessively high nitrogen content has a low resistance to aging and corrosion after deep drawing.

A first solution to this problem was proposed in the Japanese patent application No. 51-77,519 in the name of NIPPON STEEL CORP. For the purpose of reducing the nitrogen content in steel, this Japanese application teaches pouring the steel issuing from a converter, where it had been refined, into a pouring ladle previously filled with a non-nitriding gas, this ladle having been closed by means of a cover of a consumable material.

As specified in this patent application, the essential principle of this process consists, before any pouring of the metal, in completely substituting for the air of the ladle a non-nitriding gas by injecting this gas into this ladle and by covering the ladle with a cover, the two steps, when taken separately, failing to achieve the required objective, i.e. the reduction in the amount of nitrogen absorbed by the steel in the course of this pouring into a ladle. According to one manner of proceeding, use is made of a carbon dioxide in the form of dry ice blocks placed in the bottom of the ladle before the latter is closed by the cover.

More recently, the authors of this patent application published an article entitled "Conditions for the prevention of the absorption of nitrogen in the course of the production of steel"-Y. ABE-Y. KATAYAMA-M. NISHIMURA-T. TAKAHASHI-NIPPON STEEL CORP. J.S.C. (Japanese Science Council)-05.21.1981, in which they mention the use of these blocks of dry ice and its limitations. Thus, it is mentioned that the ice blocks must have a maximum size on the order of a 600 mm side dimension so as to avoid projections of molten metal. Further, the minimum size is on the order of 40 mm so as to avoid total sublimation before pouring and infiltration of air in the ladle. In practice, it is recommended to use blocks of 100 to 200 mm side dimension. Further, the time between the placing of the blocks in the receiving container and the pouring of the metal is on the order of one hour.

Thus it appears from these various publications that this process consists in completely expelling the air from the ladle while maintaining a cover on the top of the latter. The use of dry ice blocks gives the impression that, owing to the rather slow sublimation of these blocks, the gaseous carbon dioxide progressively expels the air from the ladle (the density of $CO_2$ is higher than that of air), which probably would not have been the case if the sublimation of carbon dioxide had been rapid, creating gas currents in the ladle and thereby maintaining a mixture of carbon dioxide and air in the ladle.

Further, it is recommended in these various publications to maintain the blocks of dry ice on the surface of the liquid metal in the ladle throughout the pouring of the liquid.

After various trials, the applicant has found that the process described hereinbefore had a number of drawbacks.

First of all, the necessary presence of a consumable cover, without which the announced results cannot be obtained, increases the costs of fabrication (additional material and labour). Further, the operator must direct the stream of liquid metal onto the weakest zone of the cover.

Moreover, the use of blocks of ice requires many handling operations (cutting of the blocks, conditioning, supply, store handling, etc . . . ) which is not conducive to steel plant simplicity.

It has also been found that the protection of the pouring jet was usually ineffective owing to the presence of a mixture of air and gaseous carbon dioxide, which phenomenon is rendered more serious by the temperature gradients in the ladle. Lastly, if the teaching of the patent is compiled with, i.e. the maintenance of the dry ice blocks on the surface of the liquid metal in the ladle, the process is particularly dangerous. Indeed, there are explosions in the molten metal due to the sublimation of the carbon dioxide under the blocks creating gas pockets which burst on the surface and result in projections of molten metal. The cover of consumable material is not sufficient to avoid the projections of molten metal which, in addition, creates entries of air into the ladle, which is the opposite of the desired result.

It is also known from the Belgian patent No. 677,958 to add carbon dioxide $CO_2$, in the form of carbon dioxide snow in the bottom of the ingot mould before the pouring of effervescent steel from a ladle into the latter and on the surface of the liquid metal during the filling of the mould. The effervescent steel, i.e. the steel containing a large quantity of dissolved oxygen, has the big advantage of resulting in ingots whose surface in contact with the ingot mould is perfectly devoid of waste. Thus, the carbon dioxide is decomposed, under the conditions of operation described in this patent, into oxygen and carbon monoxide which burns in contact with the air, while the oxygen permits an intensification of the desired effervescence phenomenon.

In contrast to the teaching of this Belgian patent, the process of the invention permits the use of carbon dioxide in the form of carbon dioxide snow for protecting the surface of the bath of steel in such manner as to obtain both a small amount of oxygen dissolved in the steel, after killing, and a small amount of nitrogen, while avoiding the aforementioned drawbacks. The process for producing killed steel according to the invention from effervescent steel comprises pouring the effervescent steel into the ladle in a sufficient amount to permit the introduction of killing additives and, prior to the introduction of these killing additives, injecting carbon dioxide in the form of carbon dioxide snow in the vicinity of the lower part of the pouring jet and on the surface of the bath of steel in the ladle in a sufficient amount to protect the surface of the molten metal from the surrounding air upon the introduction of the killing additives in the ladle.

It has indeed been found that, while the presence of carbon dioxide snow in the neighborhood of the bottom of the pouring jet had no effect on the absorption of nitrogen by the effervescent steel, upon the introduction of killing additives such as aluminium, silicon, etc . . . , on the other hand, the presence of carbon dioxide at the lower part of the jet and on the surface of the bath of steel would avoid the the re-nitriding of the killed steel without need to proceed as in the aforementioned Japanese patent. Further, it is found that the process as defined heretofore permits a reduction in the losses of aluminium dissolved in the steel to the extent of 25%, which renders the process more economical, since the amount of aluminium required for the killing is in this way reduced. Further, this process is economical with respect to the process described in the aforementioned Japanese patent, since the carbon dioxide is introduced later and consequently there is a lower consumption thereof.

Usually, it is found that the mass per volume of the carbon dioxide snow employed (mass per volume of the solid particles of this carbon dioxide snow) must be less than or equal to 1.1 kg/dm$^3$.

In practice, the carbon dioxide snow suitable for carrying out the invention is a snow produced by an apparatus termed a cyclone. This snow comes from the sudden expansion of the liquid carbon dioxide, which is usually stored at a temperature of −20° C. and a pressure of 20 bars, directly in the atmosphere, i.e. at ambient temperature and pressure. The snow thus formed is used as such, usually without any other treatment. In practice, this permits placing the carbon dioxide snow generator in proximity to the place of the pouring and injecting this snow into the ladle through a supply conduit connected to the cyclone. The continuous or sequential supply of snow may thus be easily controlled by the operator who controls the pouring of the metal.

Usually, the quantities of necessary carbon dioxide snow range from 0.2 to 5 kg per metric ton of poured metal.

As concerns the introduction of the carbon dioxide snow into the ladle, a person skilled in the art knows that, generally, the pouring from a converter into a ladle has a duration $t_1$ which varies as a function of the erosion of the pouring hole of the converter. On the other hand, the duration required for introducing and dissolving killing additives has a fixed value $t_2$ for a given volume. Under these conditions, a person skilled in the art will introduce the snow at the latest at instant $t_3$ after the beginning of the pouring equal to $t_1-t_2$.

This process is of course preferably applicable to the protection of the pouring jet between the converter and the ladle but may also be applicable to the pouring from a first ladle into a second ladle or into a continuous pouring distributor and from the distributor into the ingot moulds, etc . . . .

A better understanding of the invention will be had from the following manners of proceeding given by way of non-limiting examples with reference to the accompanying drawings in which.

Figure 1:
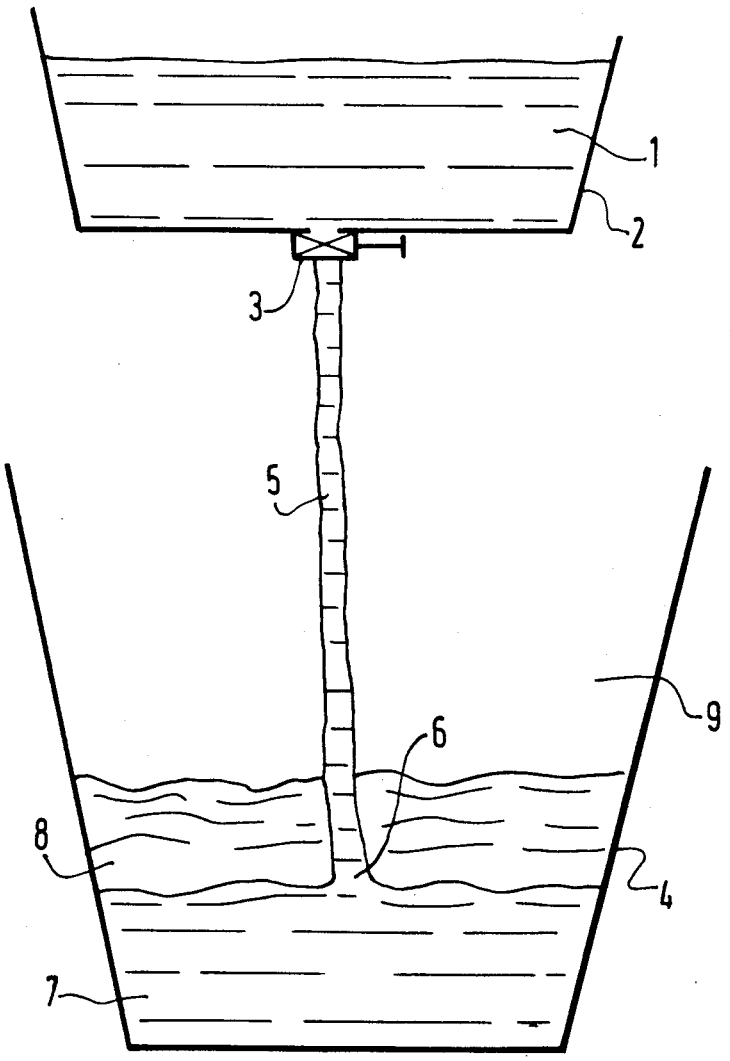
FIG. 1 is a sectional view of the pouring of effervescent steel from a converter into a ladle employing the process according to the invention.

In FIG. 1, the effervescent steel 1 is contained in a converter 2 under the orifice 3 of which the ladle 4 is positioned.

When the ladle is partly filled, a predetermined quantity of carbon dioxide snow is injected before injecting the killing additives, such as aluminium and silicon and the additives (if required) such as silicomanganese, ferrovanadium, carburized ferromanganese, ferroneobium, carbon in the form of carburite, etc . . . , which additives are well known for imparting the required properties and grades to steels. The liquid metal 5 immediately sublimates the carbon dioxide snow present in the zone of the lower end 6 of the jet and in the zone located above the layer of liquid metal 7 and thus creates a layer 8 of carbon dioxide surmounted by a layer 9 of air. The liquid metal 7 together with the layer of carbon dioxide (which is heavier than the air) thus form a piston, as the liquid level rises, which expels the air from the ladle, the lower end of the jet being in this way constantly protected.

Figure 2:
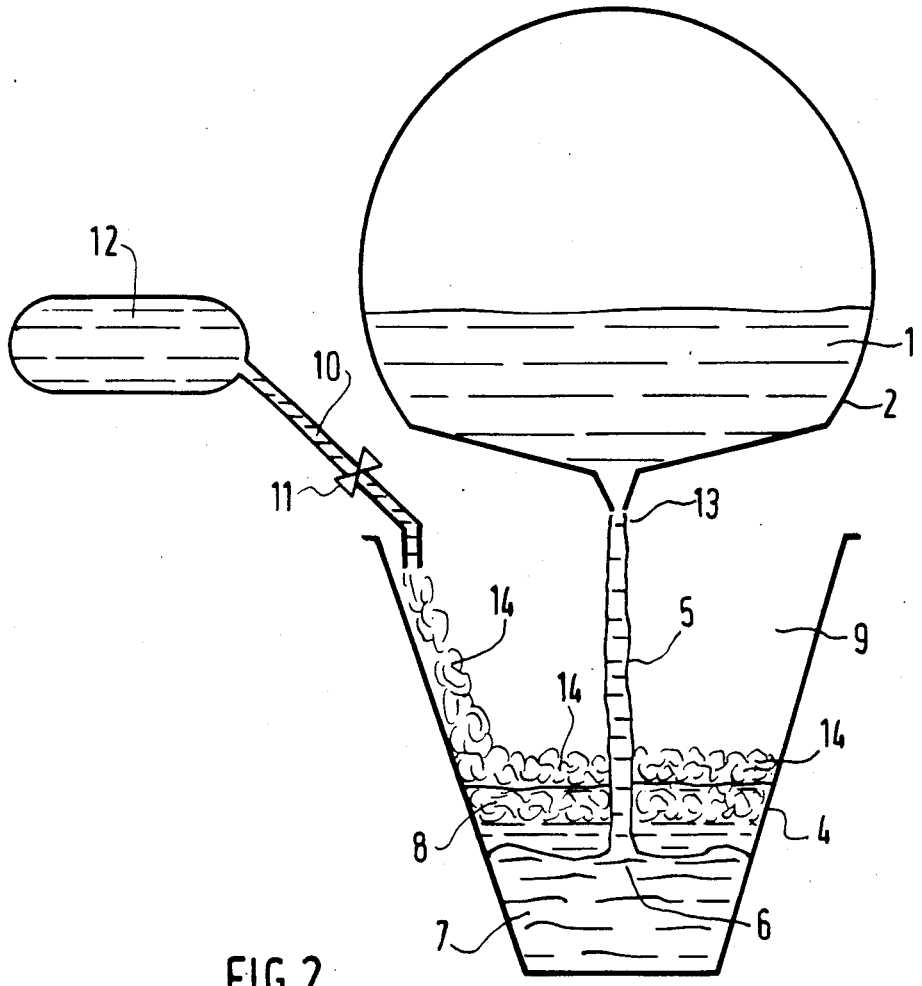
FIG. 2 is a sectional view of a modification of the process shown in FIG. 1, including a supply of carbon dioxide snow in situ.

FIG. 2 shows a modification of FIG. 1 in which the carbon dioxide snow is injected into the ladle just before the addition of the killing additives (continuously or sequentially) through a supply pipe 10 which is connected to the liquid carbon dioxide tank 12 and to the ladle 4 through an expansion valve 11. The snow 14 is spread over the whole of the liquid metal. For this purpose, a symmetrical supply system must be provided at a plurality of points.

The continuous or sequential supply from the tank 12 produces, by expansion of the liquid $CO_2$, about 40% solid and 60% gas. the latter dilutes the atmosphere of the ladle and improves the protection of the pouring jet. Further, this gas, which is heavier than the air, is heated upon contact with the liquid metal before being drawn toward the surface of said metal so that an excessive cooling of the metal is avoided.

Figure 3:
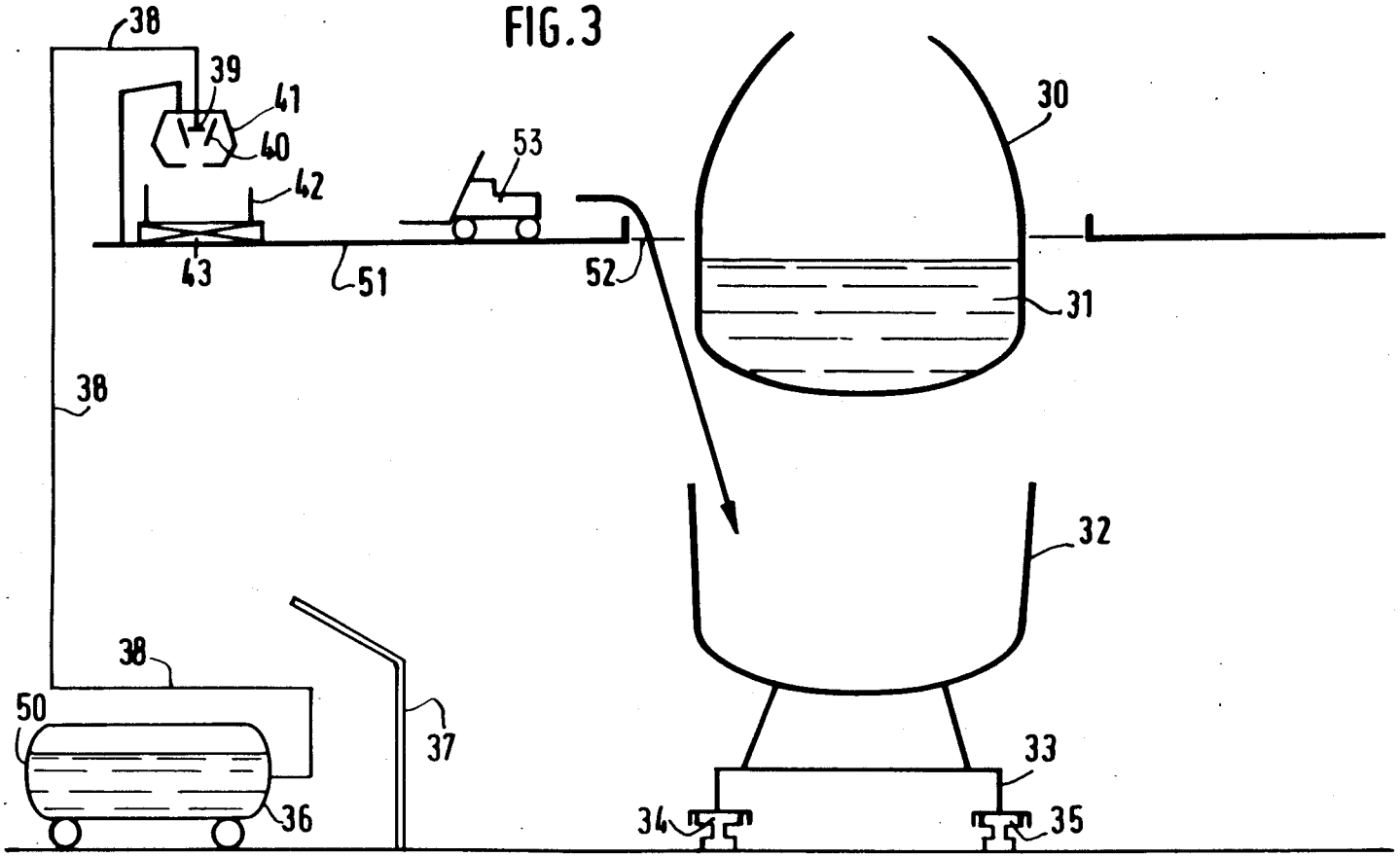
FIG. 3 is a diagrammatic view of a pouring plant employing the process according to the invention.

FIG. 3 is a simplified view of the carrying out of the process according to the invention. A receiving ladle 32 is placed under the converter 30 containing the molten steel 31, this ladle being supported by a carriage 33 travelling along rails 34 and 35. A tank 36 of liquid carbon dioxide 50 is placed at the same level as the latter. This tank is protected by a fire wall 37. The liquid carbon dioxide is sent (by means not shown in the drawings) through a pipe 38 to a carbon dioxide snow producing apparatus 41 termed a carbocyclone, such as those sold by the firm CARDOX.

The pipe 38 terminates in two nozzles diagrammatically represented at 39 and oriented at 180° to each other which perform the function of expansion orifices for bringing to ambient temperature and pressure the carbon dioxide which is stored at about −20° C. and 20 bars in the tank 36. This expansion in the downwardly tapering cone 40 produces carbon dioxide snow which is stored in a bin 42 placed on a balance 43. When the required quantity is stored in the bin, the injection is stopped and the bin is placed, by forklift 53, on the pouring floor 51 located on the level of the converter above the ladle. The snow is poured through the opening 52 in the floor 51 from the bin 42 into the ladle 32 a few instants before the addition of the killing additives.

By means of such a device, and knowing the hourly production of the carbocyclone, it is easy to produce the amount of snow within the desired time so as to be ready when the amount of steel poured into the ladle is judged to be sufficient. In practice, a carbocyclone having an instantaneous supply of snow of 1200 kg/hour is suitable for supplying a steelworks.

EXAMPLE 1

There is poured from a converter into a ladle 1 metric ton of an effervescent steel comprising 1.5% carbon, 10% chromium, 0.09% silicon, 0.08% manganese, 0.012% sulphur and 0.011% phosphorus.

When the ladle is filled to about one third of its height before the killing operation, there is injected carbon dioxide snow coming from the sudden expansion at ambient temperature of the liquid carbon dioxide stored at −20° C. and 20 bars. The quantity employed was about 1 kg. A few seconds after having finished the injection of snow into the ladle, brought to about 900° C., the steel killing additives are added and the pouring is continued until the ladle is completely filled, which takes about 1 minute.

A specimen of the liquid steel is taken from the converter before pouring and from the ladle after pouring.

The same operation is carried out under the same conditions, but without the use of carbon dioxide snow, which will be termed the reference pouring, and specimens are taken in the same way.

The results obtained are the following:

| | Concentration of nitrogen in converter specimen (ppm) | Concentration of nitrogen in ladle specimen (ppm) | Variation of concentration (ppm) |
|---|---|---|---|
| Reference pouring | 105.65 | 157.9 | +52.25 |
| Pouring of the invention | 70 | 89.15 | +19.15 |

With respect to the reference pouring, the re-nitriding of the pouring according to the invention has diminished by 37%.

Note that the initial concentration of nitrogen in the ladle is not the same in the two cases, since it is impossible to have the same initial concentrations of nitrogen for two successive melts carried out under the same conditions. However, it has been ascertained that the reduction in the re-nitriding does not depend on the initial concentration of nitrogen.

EXAMPLE 2

The procedure is carried out under conditions similar to those of Example 1 but with a ladle receiving 6 metric tons of effervescent steel comprising 0.2 to 0.3% carbon, 0.6 to 0.7% manganese and 0.2 to 0.7% silicon. The steel is poured into the ladle up to about one third full. Then about 5 kg of carbon dioxide snow is injected (in one continuous injection or in several discrete injections until the end of the pouring). Then the acid killing additives are added in the known manner.

The results obtained are the following:

| | Concentration of nitrogen in converter specimen (ppm) | Concentration of nitrogen in ladle specimen (ppm) | Variation of concentration (ppm) |
|---|---|---|---|
| Reference pouring | 53 | t = 0 78 | =25 |
| | | t = +5′ 86 | =33 |
| | | t = +10′ 87 | =34 |
| Pouring according to invention | 41 | t = 0 60 | =19 |
| | | t = +5′ 60 | =19 |
| | | t = +10′ 60 | =19 |

The re-nitriding has diminished by 40%.

Two effects of the cabon dioxide snow are found in the above table, namely reduction in the absorption of nitrogen during the pouring reduction in the absorption of nitrogen after the pouring during at least 10 minutes

EXAMPLE 3

Under the same conditions as in Example 2, there is poured an effervescent steel having the following composition:

| | | | | | |
|---|---|---|---|---|---|
| C: | 0.26% | Al: | 0.08% | N: | 0.004 to 0.0111% |
| Mn: | 0.70% | P: | 0.022% | | |
| Si: | 0.27% | S: | 0.015% | | |

As before, this steel is killed with aluminium, the carbon dioxide snow having been injected just before the introduction of the aluminium. The following results show a substantial improvement in the re-nitriding and the re-oxidation (reduction in the losses of dissolved aluminium):

| | without $CO_2$ | with $CO_2$ 2.3 kg/ton | with $CO_2$ 0.4 kg/ton |
|---|---|---|---|
| losses dissolved Al | $25.5 \times 10^{-3}$% | $20.5 \times 10^{-3}$% | $17 \times 10^{3}$% |
| Re-nitriding | 32 ppm | 21 ppm | 29 ppm |

This table also shows that the quantity of carbon dioxide snow introduced can be adjusted in accordance with the desired result. More carbon dioxide snow will be supplied per ton if it is desired to avoid as far as possible the re-nitriding while avoiding the re-oxidation, while the addition of a small quantity of $CO_2$ per ton of metal surprisingly decreases the re-oxidation while it also decreases the re-nitriding.

The protection of the pouring by means of carbon dioxide snow results in a 25% reduction in the loss of aluminium dissolved in the steel. This shows the inert-rendering effect of the carbon dioxide used under the aforementioned conditions—if the latter were oxidizing with respect to air, the loss of dissolved aluminium would be very great and in any case much greater than that without a protection with $CO_2$.

What is claimed is:

1. A process for producing killed steel having a low content of nitrogen comprising pouring a jet of effervescent steel from a converter into a ladle, adding to the molten steel contained in the ladle, in the course of the pouring, additives for killing said steel, said process further comprising pouring the effervescent steel into the ladle in a quantity sufficient to permit the introduction of the killing additives, and immediately prior to the introduction of said killing additives injecting carbon dioxide in the form of carbon dioxide snow in the vicinity of the bottom of said jet and on the surface of the bath of steel in the ladle, in a quantity of 0.2 to 5 kg of carbon dioxide snow per metric ton of poured steel to protect the surface of the molten steel from surrounding air upon the introduction of the killing additives in the ladle.

2. A process according to claim 1, wherein the mass per volume of the carbon dioxide snow is at the most equal to 1.1 kg/dm$^3$.

3. A process according to claim 1, comprising introducing the carbon dioxide into the ladle in the form of the injection of carbon dioxide snow obtained directly by a sudden expansion at atmospheric pressure and at ambient temperature of liquid carbon dioxide stored under conventional conditions of temperature and pressure.

4. A process according to claim 1, comprising filling the ladle up to substantially one third of the height of the ladle before injecting the carbon dioxide snow.

5. A process according to claim 1, comprising injecting the carbon dioxide snow during at least a part of the duration of the pouring of the effervescent steel into the ladle.

6. A process according to claim 1, comprising injecting the carbon dioxide snow throughout the duration of the pouring of the effervescent steel into the ladle.

* * * * *